US008981745B2

(12) United States Patent
Price et al.

(10) Patent No.: US 8,981,745 B2
(45) Date of Patent: Mar. 17, 2015

(54) METHOD AND APPARATUS FOR BYPASS MODE LOW DROPOUT (LDO) REGULATOR

(71) Applicant: QUALCOMM Incorporated, San Diego, CA (US)

(72) Inventors: Burt L. Price, Raleigh, NC (US); Dhaval R. Shah, Raleigh, NC (US); Yeshwant Nagaraj Kolla, Wake Forest, NC (US)

(73) Assignee: QUALCOMM Incorporated, San Diego, CA (US)

( * ) Notice: Subject to any disclaimer, the term of this patent is extended or adjusted under 35 U.S.C. 154(b) by 134 days.

(21) Appl. No.: 13/788,546

(22) Filed: Mar. 7, 2013

(65) Prior Publication Data

US 2014/0139197 A1 May 22, 2014

Related U.S. Application Data

(60) Provisional application No. 61/727,714, filed on Nov. 18, 2012.

(51) Int. Cl.

| | |
|---|---|
| ***G05F 1/00*** | (2006.01) |
| ***G05F 1/46*** | (2006.01) |
| ***G05F 1/56*** | (2006.01) |

(52) U.S. Cl.

CPC ... *G05F 1/46* (2013.01); *G05F 1/56* (2013.01)
USPC ..... 323/274; 323/284

(58) Field of Classification Search

USPC ..... 323/273, 274, 282, 284, 289, 350, 351; 361/8, 13, 18, 54–57

See application file for complete search history.

(56) References Cited

U.S. PATENT DOCUMENTS

| | | | |
|---|---|---|---|
| 4,656,647 | A | 4/1987 | Hotine |
| 5,696,465 | A | 12/1997 | Ishizuka |
| 5,982,226 | A | 11/1999 | Rincon-Mora |
| 6,031,417 | A | 2/2000 | Bechman |

(Continued)

FOREIGN PATENT DOCUMENTS

| | | | |
|---|---|---|---|
| CN | 102117089 | A | 7/2011 |
| EP | 1635239 | A1 | 3/2006 |

(Continued)

OTHER PUBLICATIONS

Cristea I., et al., "Supply Concept in Input Powered Two Channel Switch", Semiconductor Conference (CAS), 2010 International, IEEE, Piscataway, NJ, USA, Oct. 11, 2010, pp. 469-472, XP031812172, ISBN: 978-1-4244-5783-0.

(Continued)

*Primary Examiner* — Adolf Berhane
*Assistant Examiner* — Gary Nash
(74) *Attorney, Agent, or Firm* — Nicholas J. Pauley; Peter Michael Kamarchik; Joseph Agusta

(57) ABSTRACT

A bypass low dropout regulator has a pass gate coupled to a voltage rail. The pass gate receives a pass gate control signal on a pass gate control line and controllably drops a voltage from a rail to a regulated output in accordance with the pass gate control signal. A differential amplifier generates the pass gate control voltage using a reference and feedback from the regulated output. A bypass switch selectively bypasses the regulator control signal, in response to a bypass signal, by placing a pass gate ON voltage on the pass gate control line. Optionally, and ON-OFF mode circuit selectively disables the pass gate in response to a system ON-OFF signal.

16 Claims, 8 Drawing Sheets

(56) References Cited

U.S. PATENT DOCUMENTS

| | | | | |
|---|---|---|---|---|
| 6,046,577 | A | 4/2000 | Rincon-Mora et al. | |
| 6,184,744 | B1 | 2/2001 | Morishita | |
| 6,188,211 | B1 | 2/2001 | Rincon-Mora et al. | |
| 6,188,212 | B1 | 2/2001 | Larson et al. | |
| 6,246,221 | B1 | 6/2001 | Xi | |
| 6,333,623 | B1 | 12/2001 | Heisley et al. | |
| 6,373,233 | B2 | 4/2002 | Bakker et al. | |
| 6,518,737 | B1 | 2/2003 | Stanescu et al. | |
| 6,522,111 | B2 | 2/2003 | Zadeh et al. | |
| 6,617,833 | B1 | 9/2003 | Xi | |
| 6,703,815 | B2 | 3/2004 | Biagi | |
| 7,091,710 | B2 | 8/2006 | Yang et al. | |
| 7,142,022 | B2 | 11/2006 | Kang et al. | |
| 7,215,103 | B1 | 5/2007 | Wong et al. | |
| 7,224,156 | B2 | 5/2007 | Chen | |
| 7,339,416 | B2 | 3/2008 | Rincon-Mora et al. | |
| 7,612,547 | B2 | 11/2009 | Renous | |
| 7,728,569 | B1 | 6/2010 | Le et al. | |
| 7,768,351 | B2 | 8/2010 | Ivanov et al. | |
| 8,044,653 | B2 | 10/2011 | Maige et al. | |
| 8,072,196 | B1 * | 12/2011 | Li | 323/266 |
| 8,080,983 | B2 | 12/2011 | Lourens et al. | |
| 8,169,203 | B1 | 5/2012 | Vemula | |
| 2006/0055383 | A1 | 3/2006 | Eberlein | |
| 2006/0232327 | A1 | 10/2006 | Takagi et al. | |
| 2007/0191683 | A1 | 8/2007 | Fujimori | |
| 2008/0061881 | A1 | 3/2008 | Takagi | |
| 2008/0081947 | A1 | 4/2008 | Irion et al. | |
| 2008/0224680 | A1 | 9/2008 | Suzuki | |
| 2009/0066306 | A1 | 3/2009 | Noda | |
| 2009/0072984 | A1 | 3/2009 | Cheng et al. | |
| 2010/0013449 | A1 | 1/2010 | Miki | |
| 2010/0156364 | A1 | 6/2010 | Cho et al. | |
| 2011/0241769 | A1 | 10/2011 | Jung | |
| 2012/0161734 | A1 | 6/2012 | Wu | |
| 2012/0176107 | A1 | 7/2012 | Shrivas et al. | |
| 2012/0212199 | A1 | 8/2012 | Amer et al. | |
| 2012/0229202 | A1 | 9/2012 | Nikolov et al. | |
| 2014/0117956 | A1 | 5/2014 | Price et al. | |
| 2014/0117958 | A1 | 5/2014 | Price et al. | |
| 2014/0125300 | A1 | 5/2014 | Price et al. | |

FOREIGN PATENT DOCUMENTS

| | | | |
|---|---|---|---|
| EP | 2082680 | A1 | 7/2009 |
| JP | 2001137182 | A | 5/2001 |
| JP | 2005205072 | A | 8/2005 |
| JP | 2006230680 | A | 9/2006 |
| JP | 2007280025 | A | 10/2007 |
| KR | 20090028282 | A | 3/2009 |
| WO | 2012104673 | | 8/2012 |

OTHER PUBLICATIONS

International Search Report and Written Opinion—PCT/US2013/070604—ISAEPO—Apr. 4, 2014.

Kim Y.I., et al., "Fast Transient Capacitor-Less LDO Regulator Using Low-Power Output Voltage Detector", Electronics Letters, IEE Stevenage, vol. 48, No. 3, Feb. 2, 2012, pp. 175-177, XP006040603, ISSN: 0013-5194, DOI: 10.1049/EL.2011.

Liu X. et al., "Design of off-chip capacitor-free CMOS low-dropout voltage regulator", Circuits and Systems, 2008. APCCAS 2008. IEEE Asia Pacific Conference on, IEEE, Piscataway, NJ, USA, Nov. 30, 2008, pp. 1316-1319, XP031405243, DOI: 10.1109/APCCAS.2008.4746270 ISBN: 978-1-4244-2341-5.

Ying O.P., et al., "An Output-Capacities Low-Dropout Regulator with Direct Voltage-Spike Detection", IEEE Journal of Solid-State Circuits, Service Center, Piscataway, NJ, USA, vol. 45, No. 2, Feb. 1, 2010, pp. 458-466, XP011301260, ISSN: 0018-9200, DOI: 10.1109/JSSC.2009.2034805.

EP Search Report dated Jun. 18, 2013.

International Search Report and Written Opinion—PCT/US2013/068522—ISA/EPO—Jun. 30, 2014.

* cited by examiner

METHOD AND APPARATUS FOR BYPASS MODE LOW DROPOUT (LDO) REGULATOR

CLAIM OF PRIORITY UNDER 35 U.S.C. §119

The present Application for Patent claims priority to Provisional Application No. 61/727,714 entitled "METHOD AND APPARATUS FOR BYPASS MODE LOW DROPOUT (LDO) REGULATOR" filed Nov. 18, 2012, and assigned to the assignee hereof and hereby expressly incorporated by reference herein.

FIELD OF DISCLOSURE

The technical field of the disclosure relates to voltage regulators and, more particular, to low dropout (LDO) regulators.

BACKGROUND

An LDO regulator is a direct current (DC) linear voltage regulator that can operate with a very low dropout, where "dropout" (also termed "dropout voltage") means the difference between the input voltage (e.g., received power supply rail voltage) and the regulated out voltage. As known in the conventional LDO regulator arts, a low dropout voltage may provide, for example, higher efficiency and concomitant reduction in heat generation, as well as lower minimum operating voltage.

SUMMARY

The following summary is not an extensive overview of all contemplated aspects. Its sole purpose is to present some concepts of one or more aspects in a simplified form as a prelude to the more detailed description that is presented later.

One or more exemplary embodiments provide a bypass low dropout (LDO) regulator that may include a pass gate coupled to a supply rail and having a regulator output and a control terminal, configured to controllably couple, in response to receiving a pass gate control signal on the control terminal, the supply rail to the regulator output. In an aspect, the LDO regulator includes a differential amplifier, configured to generate the pass gate control signal, based on a reference voltage and a feedback of the regulator output; and a bypass mode circuit configured to selectively ON override the pass gate control signal, in response to a bypass mode signal. In a further aspect, the ON override places a pass gate ON hard voltage on the control terminal.

In an aspect, the bypass mode circuit can be configured to receive the bypass mode signal at a value switchable between a bypass mode ON signal and a bypass mode OFF signal, and can be further configured to ON override the pass gate control signal in response to receiving the bypass mode ON signal.

In another aspect, an example bypass low dropout (LDO) regulator according to various exemplary may further include a pass gate control line, coupling an output of the differential amplifier to the control terminal, for carrying the pass gate control signal, and the bypass mode circuit may be configured to perform the ON override by shorting the pass gate control line, in response to receiving the bypass mode ON signal, to a power rail having the pass gate ON hard voltage.

In a further aspect, the bypass mode circuit may include a bypass mode switch configured to receiving the bypass mode signal and, in response to the bypass mode ON signal the shorting and, in response to the bypass mode OFF signal, do not perform the shorting.

In another aspect, a bypass mode circuit according to one or more exemplary embodiments may also include an ON-OFF mode switch configured to OFF override the pass gate control signal in response to receiving an LDO disable signal. The ON-OFF mode switch can be configured to provide the OFF override by placing a pass gate OFF voltage on the control terminal. In a related aspect, a bypass mode circuit according to one or more exemplary embodiments may also include an ON-OFF/bypass resolution logic. In an aspect, the ON-OFF/bypass resolution logic can be configured to receive the bypass mode signal and a system ON-OFF mode signal and, in response, to select in accordance with a given priority between generating the LDO disable signal and not generating the LDO disable signal.

In an aspect, a bypass mode circuit according to one or exemplary embodiments may be configured to receive the bypass mode signal at a value switchable between a bypass mode ON signal and a bypass mode OFF signal, and can be further configured to ON override the pass gate control signal in response to receiving the bypass mode ON signal. In a related aspect, the bypass low dropout regulator can further include an ON-OFF mode circuit that can be configured to receive the bypass mode signal and a system ON-OFF mode signal that is switchable between system ON-OFF mode ON signal and system ON-OFF mode OFF signal. In another related aspect, the ON-OFF mode circuit can be further configured to disable the pass gate, in response to a concurrence of receiving the system ON-OFF mode OFF signal and the bypass mode OFF signal, by placing a pass gate OFF voltage on the control terminal.

In another aspect, an bypass mode circuit according to one or more exemplary embodiments may also include an ON/OFF bypass resolution logic that may be configured to receive the bypass mode signal and a system ON-OFF mode signal and, in response to a concurrence of receiving the bypass mode OFF signal and the system ON-OFF mode OFF signal, to generate an LDO disable signal, and to include an ON-OFF mode switch that may be configured to receive the LDO disable signal and, in response, perform an OFF override of the pass gate control signal. In an aspect, the OFF override may place a pass gate OFF voltage on the control terminal In an aspect, an bypass mode circuit according to one or more exemplary embodiments may further include an ON-OFF mode switch configured to OFF override the pass gate control signal in response to an LDO disable signal, and to perform the OFF override by placing a pass gate OFF voltage on the control terminal, and to also include an ON-OFF/bypass resolution logic configured to receive the bypass mode signal and a system ON-OFF mode signal and, in accordance with a given priority, select between generating the LDO disable signal and not generating the LDO disable signal.

Example methods according to one or more exemplary embodiments may provide bypassing a low dropout (LDO) regulator, and may include generating a pass gate control signal based on a difference between a regulated output voltage of a pass gate and a reference voltage, and may include receiving a bypass mode signal that is switchable between a bypass mode ON signal and a bypass mode OFF signal, and may further include conditionally controlling a conductance of the pass gate based at least on the pass gate control signal and receiving the bypass mode signal. In an aspect, the conditionally controlling can provide the conductance of the pass gate as based, at least in part, on the pass gate control signal when receiving the bypass mode OFF signal and, when receiving the bypass mode ON signal, provide the conductance of the pass gate as based, at least in part, on the bypass mode ON signal.

In one aspect, methods according to one or more exemplary embodiments may include, controlling the conductance of the pass gate when receiving the bypass mode ON signal may include placing a pass gate ON voltage on a control terminal of the pass gate, shorting a control terminal of the pass gate to a power rail having a pass gate ON voltage, and/or overriding the pass gate control signal.

One example apparatus according to one or more exemplary embodiments may provide bypassing a low dropout regulator, and may include means for generating a pass gate control signal based on a difference between a regulated output voltage of a pass gate and a reference voltage, and means for conditionally controlling a conductance of the pass gate based at least on the pass gate control signal and receiving a bypass mode signal that is switchable between a bypass mode ON signal and a bypass mode OFF signal. In an aspect, the means for conditionally controlling can be configured to control the conductance of the pass gate based, at least in part, on the pass gate control signal when receiving the bypass mode OFF signal and, when receiving the bypass mode ON signal, to control the conductance of the pass gate based, at least in part, on the bypass mode ON signal.

BRIEF DESCRIPTION OF THE DRAWINGS

The accompanying drawings found in the attachments are presented to aid in the description of embodiments of the invention and are provided solely for illustration of the embodiments and not limitation thereof.

DETAILED DESCRIPTION

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration," Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is only for the purpose of describing particular examples according to embodiments, and is not intended to be limiting of embodiments of the invention. As used herein, the singular forms "a", "an" and "the" are intended to include the plural forms as well, unless the context clearly indicates otherwise. As used herein the terms "comprises", "comprising,", "includes" and/or "including" specify the presence of stated structural and functional features, steps, operations, elements, and/or components, but do not preclude the presence or addition of one or more other structural and functional feature, steps, operations, elements, components, and/or groups thereof.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields, electron spins particles, electrospins, or any combination thereof.

The term "topology" as used herein refers to interconnections of circuit components and, unless stated otherwise, indicates nothing of physical layout of the components or their physical locations relative to one another. Figures described or otherwise identified as showing a topology are no more than a graphical representation of the topology and do not necessarily describe anything regarding physical layout or relative locations of components.

Figure 1:
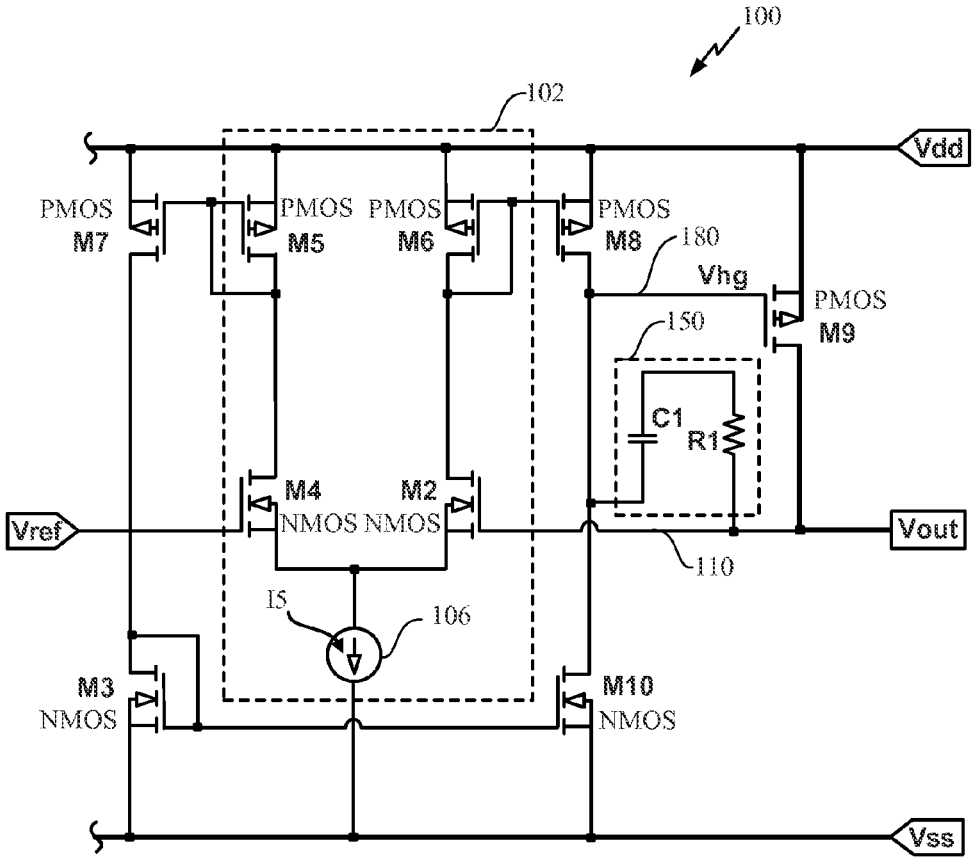
FIG. 1 shows a topology for one example LDO regulator unit.

FIG. 1 shows one topology for one example LDO regulator 100, having a differential amplifier 102 and a pass gate M9 that controllably feeds a regulator output, labeled Vout, from an external power rail or supply rail Vdd. The differential amplifier 102 operates by receiving at one of its differential inputs a reference voltage, Vref and, at the other of its inputs, a feedback of Vout over feedback path 110. The differential amplifier 102 generates, based on the difference of Vref and the fed back Vout, a pass gate control signal, or voltage, labeled Vhg on the pass gate control line 180. The feedback configuration of the differential amplifier 102 forces Vhg to a value at which the pass gate M9 resistance, and resulting voltage drop, provide Vout as approximately equal to Vref Driving the pass gate M9 to a resistance at which Vout is approximately equal to Vref is only for purposes of example. Alternatively, a percentage of Vout may be fed back, e.g., by using a voltage divider (not shown), to generate Vout higher than Vref.

Referring to FIG. 1, differential amplifier 102 may be formed of two parallel branches (shown but not separately numbered) extending from the Vdd rail to a common node (shown but not separately numbered) and a tail current source 106 coupled to the common node. One of the two branches comprises internal load transistor M5 in series with input transistor M4, the other comprises internal load transistor M6 in series with input transistor M2. The branch having internal load transistor M5 in series with input transistor M4 may be referenced alternatively as the "first branch," and the input transistor M4 may be referenced alternatively as the"first transistor" M4. Likewise, the branch having internal load transistor M6 in series with input transistor M2 may be referenced alternatively as the "second branch," and the input transistor M2 may be referenced alternatively as the "second transistor" M2. It will be understood that "first" and "second," in this context, are arbitrarily assigned. Further, the first input transistor M4 and the second input transistor M2 may referenced collectively as "the input transistors M2 and M4." The current T5 of the tail current source 106 sets the bias of the input transistors M2 and M4. 15 is fixed. The gate (shown but not separately numbered) of input transistor M4, functioning as one of the differential amplifier 102 inputs, receives Vref. The gate (shown but not separately labeled) of input transistor M2, functions as the other of the differential amplifier 102 inputs, and receives Vout through the feedback path 110.

In an aspect, a compensation network 150 may be included. The FIG. 1 example compensation network 150, formed of resistor element R1 and capacitor element C1, can place a zero in the frequency response of the feedback loop. Other compensation networks may be included, to provide or compensate for various other loop characteristics.

With continuing reference to FIG. 1, an intermediate buffer stage (shown but not separately numbered) may be provided between the differential amplifier and the Vhg control voltage, such as provided by transistors M3, M7, M8, and M10. The drain of M8 is coupled to the pass gate control line 180, and M8 may be referred to as the Vhg drive transistor.

In certain applications, a "headswitch" (not shown in FIG. 1) may selectively bypass an LDO regulator such as the example LDO regulator 100. The selective bypass may be, for example, a PMOS switch (not shown in FIG. 1) arranged such that when it is ON it shorts Vdd to Vout. This bypasses the pass gate M9, thereby providing unregulated Vdd on the Vout. Such applications may include, or operate in conjunction with, a multicore power management. To reduce resistive losses, and provide high current capacity, the headswitch may be a large semi-conductor, e.g., PMOS switch.

According to one exemplary embodiment, one candidate implementation for the headswitch may be the pass gate M9, which is a PMOS device. For example, a circuit (not shown in FIG. 1) may be configured to drive Vhg, or the pass gate control line 180 driven by the pass gate control PINTOS M8, to a voltage that drives the pass gate M9 ON hard. Certain applications, though, may have stability and bandwidth requirements that can impose a maximum on the size of the PMOS pass gate, e.g., the pass gate M9, such that a pass gate large enough to provide acceptable ON conductance may exceed that maximum size.

Various exemplary embodiments provide a bypass LDO regulator, configured to have a bypass mode in which the pass gate (e.g., the FIG. 1 pass gate M9) may be driven ON hard, and usable apart from its LDO regulator function. Bypass LDO regulator devices and methods according to exemplary embodiments may provide, among other features and benefits, a supplementary Vdd feed to the Vout line. In addition, embodiments contemplate an array of such bypass LDO regulators, forming a distributed LDO regulator controlled Vout line when operating in a normal mode, and providing a corresponding array, or distribution, of supplementary Vdd feeds to the Vout line when operating in the bypass mode.

In one aspect, a bypass mode switch (e.g., the FIG. 2 bypass mode switch 204, described later in greater detail) may be provided, switchable between a first position and a second position in response to a bypass mode signal that may be switchable between an ON state (or value) and an OFF state (or value). In a further aspect, the bypass mode switch may be arranged to switch to the first position in response to the bypass mode signal being in a bypass OFF state, and to switch to the second position in response to the bypass mode signal being in a bypass ON state. In a related aspect, the bypass mode switch may be arranged to not interfere with the pass gate control signal when in the first position and, when in the second position, to override the pass gate control signal and force the pass gate M9 to an ON state. For example, assuming the pass gate is a PMOS pass gate such as FIG. 1 pass gate M9, the bypass mode switch may be configured to short the pass gate control line 180 to Vss when the bypass mode signal has the bypass ON state, thereby forcing the pass gate M9 to a saturated ON state. In this example, the bypass mode switch may be configured to be open in response to the bypass mode signal having a bypass OFF state.

Figure 2:
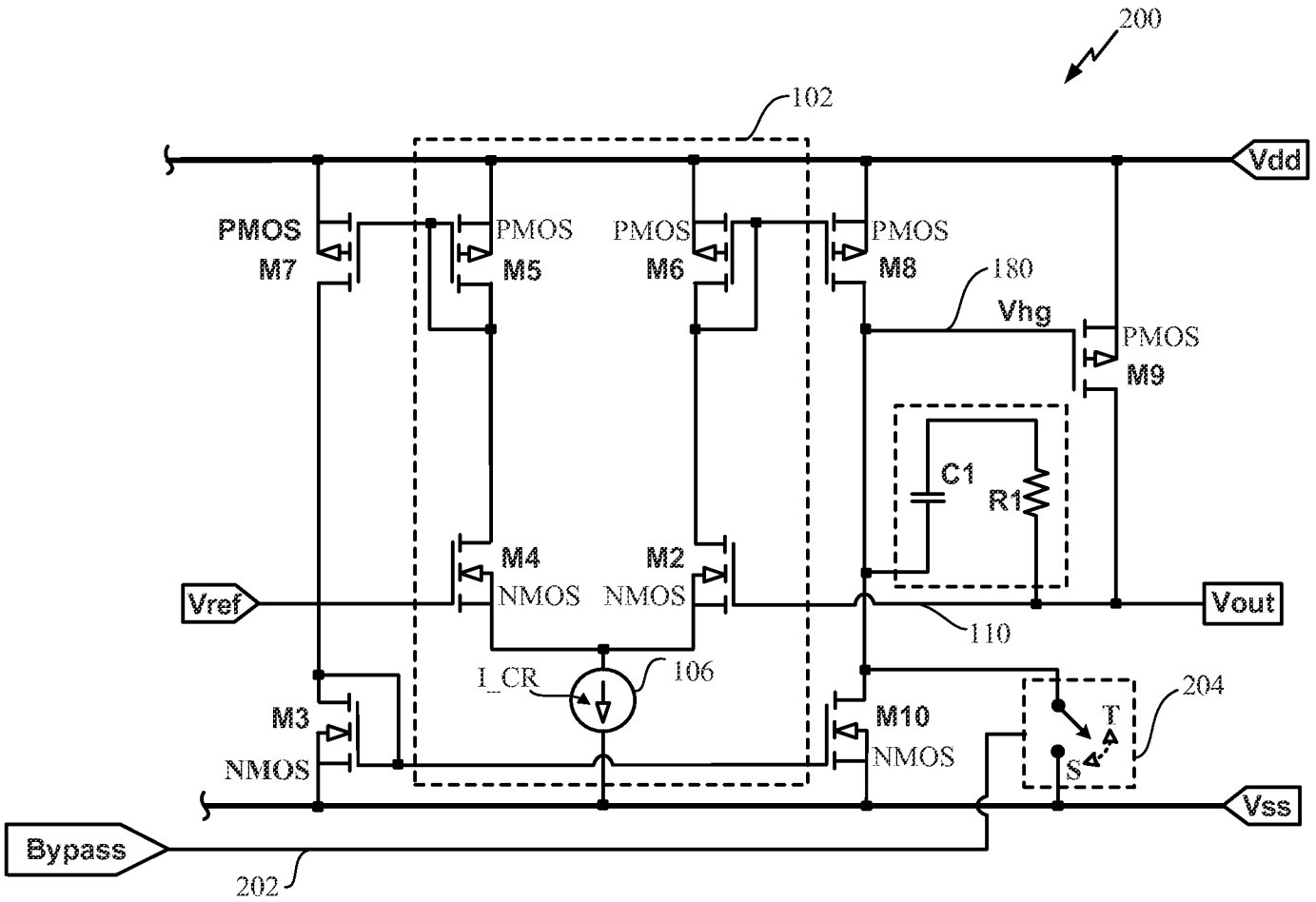
FIG. 2 shows one topology of one bypass mode LDO regulator in accordance with one or more exemplary embodiments.

FIG. 2 shows one topology for one example bypass mode LDO regulator 200, in accordance with one or more exemplary embodiments. The FIG. 2 bypass mode LDO regulator 200 is shown as an example implementation adapted to, or utilizing portions of the FIG. 1 example LDO regulator 100. This is for clarity in describing bypass mode LDO regulator concepts according to various exemplary embodiments without obfuscation by description of another entire LDO regulator topology, including structures not necessarily specific to the embodiments. It will be understood that the FIG. 2 example is not intended, though, to limit the scope of any of the exemplary embodiments to structures or practices employing LDO topologies as shown by FIG. 1.

Referring to FIG. 2, the bypass mode LDO regulator 200 includes a bypass mode switch 204 controlled by a bypass mode signal, labeled "Bypass," which may be carried on, for example, a bypass mode control line 202. In an aspect, the bypass mode switch 204 can be switchable between a normal mode (NM) position, which is open in the example configuration, and a bypass mode (BM) position, which is closed in the example configuration. For purposes of describing example operations, the following state convention will be used: "Bypass ON" means Bypass=1, and "Bypass OFF" means Bypass=0, where "0" and "1" are logical values, embodied as respective voltages and/or polarities that may be application-specific. Further to providing selective switching between a normal LDO regulation state (i.e., "bypass mode OFF") and a bypass state (i.e., "bypass mode ON"), the bypass mode switch 204 may be configured to switch to (or remain in) the bypass mode ON state in response to Bypass ON (i.e., Bypass=1), and switch to (or remain in) the normal LDO regulation state in response to Bypass OFF (i.e., Bypass=0).

For convenience in describing example operations, the Bypass mode signal in the OFF state will be alternatively referenced as the "Bypass mode OFF signal," and the Bypass signal in the ON state will be alternatively referenced as the "Bypass mode ON signal."

It will be appreciated that the bypass mode LDO regulator 200 may provide conventional type control of the conductance of the pass gate M9 in response to the Bypass mode OFF signal and, in response to the Bypass mode signal switching to the Bypass mode ON signal, provide an override control that switches the pass gate M9 ON hard. This, in turn, efficiently switches the mode of the pass gate M9 to function as, for example, a supplemental head switch.

Figure 3:
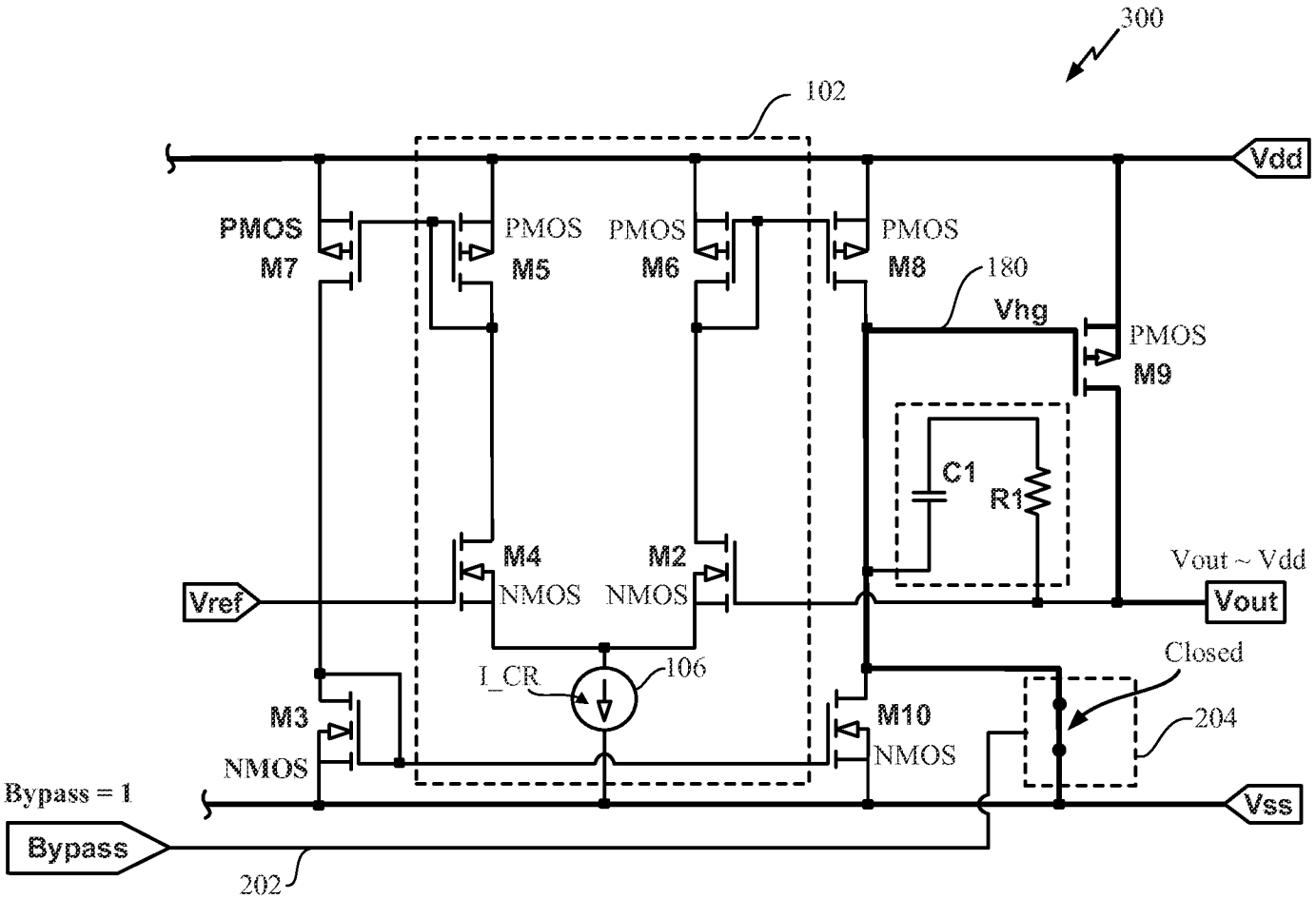
FIG. 3 shows a bypass mode state of the FIG. 2 bypass mode LDO regulator.

FIG. 3 shows a bypass mode state 300 of the FIG. 2 the bypass mode LDO regulator 200 resulting, according to the above-described convention, from Bypass ON (i.e., Bypass=1). Referring to FIG. 3, the bypass mode state 300 is formed by the bypass mode switch 204 switching to the closed position, and thereby shorting the pass gate control line 180 to Vss, in other words placing a pass gate ON voltage on the control terminal (shown but not separately labeled) of the pass gate M9. As a result, the pass gate M9 is switched ON hard, meaning to a fully saturated ON state. The voltage drop applied by the pass gate M9 is therefore acceptably small, thereby providing the pass gate M9 as a supplemental Vdd current feed or, effectively, a supplemental headswitch.

Further exemplary embodiments provide a bypass mode/ON-OFF mode LDO regulators configured to have a combination of an ON-OFF mode (or "power-down" mode) and a bypass mode. In an aspect, the ON-OFF mode of a bypass mode/ON-OFF mode LDO regulator according to various exemplary embodiments may be provided by an ON-OFF mode switch, controlled by an ON-OFF switch control signal. The ON-OFF switch control signal may be generated to switch the ON-OFF mode switch between a first position, causing no interference with the pass gate control signal, and a second position that overrides the pass gate control signal. In a further aspect, bypass mode/ON-OFF mode LDO regulators in accordance with various exemplary embodiments may include ON-OH/Bypass resolution logic that provides co-operative, priority-based mode switching between the ON-OFF mode and the bypass mode. In one aspect, the ON-OFF/Bypass resolution logic may include logic that receives the system ON-OFF mode signal and the Bypass mode signal and, in accordance with one given priority, provides bypass override, by the Bypass mode signal, of action by the system ON-OFF mode signal.

Figure 4:
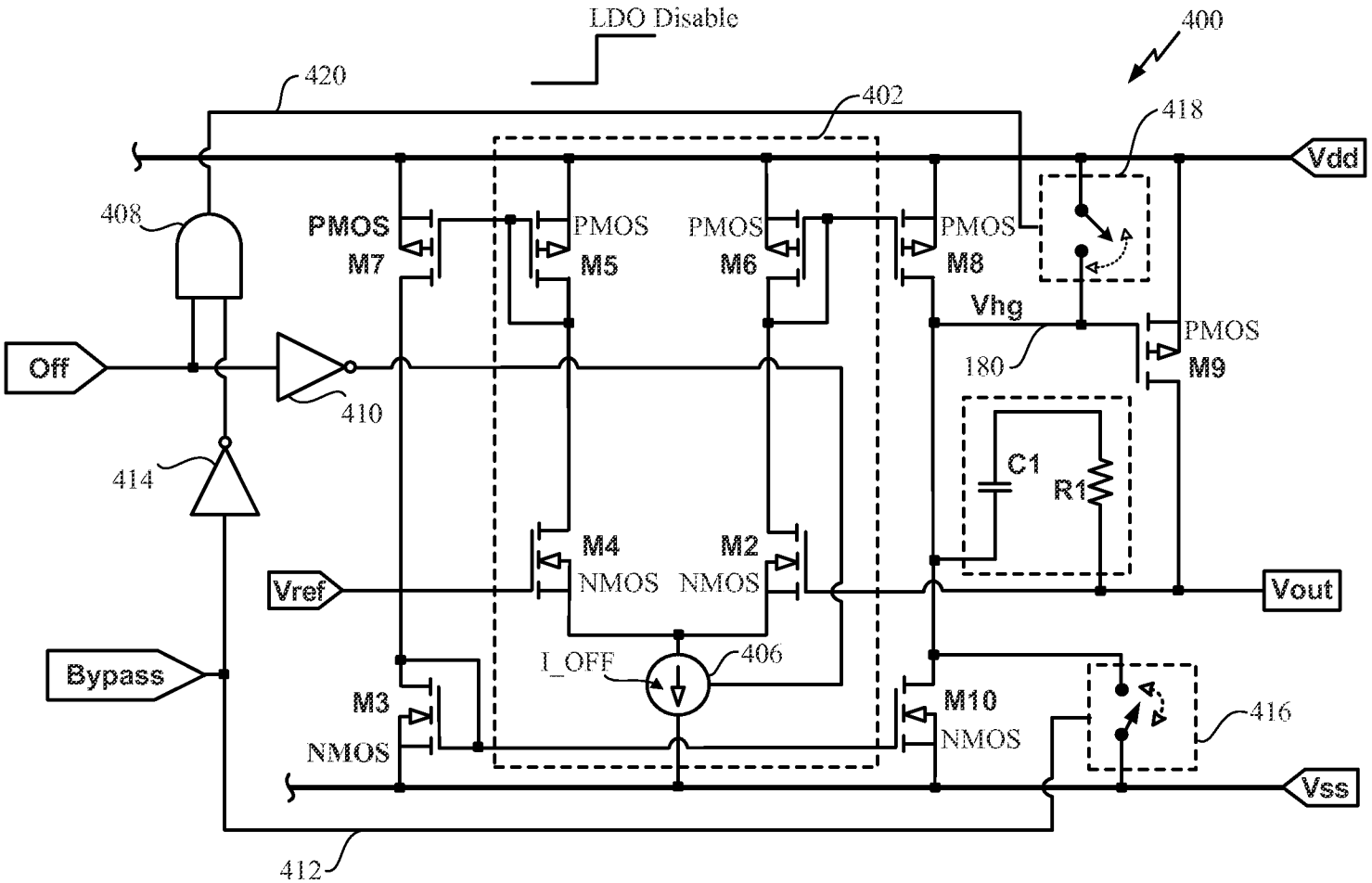
FIG. 4 shows one topology for one example bypass mode/ON-OFF mode LDO regulator, in accordance with one or more exemplary embodiments.

FIG. 4 shows one topology for one example bypass mode/ON-OFF mode LDO regulator 400, in accordance with one or more exemplary embodiments. The FIG. 4 bypass mode/ON-OFF mode LIDO regulator 400 is shown in an example implementation adapted to, or utilizing portions of the FIG. 2 bypass mode LDO regulator 200. It will be understood, however, that the FIG. 4 example is not intended to limit the scope of any of the exemplary embodiments to LDO topologies such as shown by FIG. 2.

Referring to FIG. 4, the bypass mode/ON-OFF mode LDO regulator 400 includes differential amplifier 402 having, for example, the same topology as the FIG. 1 differential amplifier 102, but using a switchable tail current source 406 in place of the FIG. 1 fixed tail current source 106. The switchable tail current source 406 is shown controlled by a system ON-OFF mode signal, in an example polarity configuration adapted to perform the control through an inverter 410. For purposes of describing example operations, a convention will be assumed for the system ON-OFF mode signal. The assumed convention will be "ON" corresponds to the system ON-OFF mode signal="0" and, in response, the bypass mode/ON-OFF mode LDO regulator 400 will not operate in a power-down mode. Using the same assumed convention, the system ON-OFF mode signal being OFF corresponds to the system ON-OFF mode signal="1" and, in response, the bypass mode/ON-OFF mode LDO regulator 400 switches to its power-down mode. It will be understood that the above naming scheme for the system ON-OFF mode signal ON and OFF states is only for convenience in describing example operations. Alternative naming schemes can be used. For example, the system ON-OFF mode signal being OFF can be called a "system ON-OFF mode OFF signal" and, the system ON-OFF mode signal being ON can be called a "system ON-OFF mode ON signal."

The power-down mode, as will be described in greater detail at later sections, may include a switching of the switchable tail current source 406 to a reduced current or OFF state and, subject to override by action of the Bypass mode signal, a disabling of the pass gate M9. As also described in greater detail at later sections, in an aspect, the switchable tail current source 406 may be configured to source, in its ON state, an operating biasing current and, in its OFF state, an off-state biasing current. In an aspect, disabling the pass gate M9 by the system ON-OFF mode signal, subject to override by action of the Bypass mode signal, can be provided by a logic implemented by, for example, the illustrated combination and arrangement of the AND gate 408 and inverter 414, controlling, through control line 420 or equivalent, the ON-OFF mode switch 418. The combination of the AND gate 408 and inverter 414 and the ON-OFF mode switch 418 can be collectively referenced as the "ON-OFF mode circuit" (not separately numbered). Features provided by the ON-OFF mode circuit include resolution, according to a logical priority as described, between the system ON-OFF mode signal and the Bypass mode signal and, based on the resolution, generating the example LDO disable signal controlling the ON-OFF mode switch 41$. The combination of the AND gate 408 and inverter 414 of the ON-OFF mode circuit thereby provide an ON/OFF bypass resolution logic (not separately numbered) in accordance with various exemplary embodiments. Operations illustrating resolution and cooperative action provided by the ON/OFF bypass resolution logic (e.g., AND gate 408 and inverter 414) will be described in greater detail at later sections, for example in reference to FIGS. 5A-5C.

It will be understood that the AND gate 408 and inverter 414 show only an example of a ON/OFF bypass resolution logic and are not intended as a limit of the scope of any of the various exemplary embodiment. Operations and features of the cooperation will be described in greater detail at later sections, for example in reference to FIGS. 5A-5C.

Referring to FIG. 4, the ON-OFF mode switch 418 may be a single-pole-single throw switch controlled by a logic such as the AND gate 408 to switch between an open, or first position, and a closed, or second position. When events at the input of the AND gate 408, described later in greater detail, cause its output to switch the ON-OFF mode switch 41$ to the closed position, the pass gate control line 180 is shorted to Vdd. Since the pass gate M9 is a PMOS device, the pass gate M9 is disabled, or cut off.

The combination of the inverter 414 and AND gate 408 provides co-operation between the ON-OFF mode signal and the Bypass mode signal, by providing the latter with override of the former. Operations showing aspects and examples of the cooperation are described in greater detail at later sections. As one preliminary example, assume the system ON-OFF mode signal is switched to the system ON-OFF mode OFF signal, i.e., equal to "1" (high), and the Bypass mode signal is switched to the Bypass mode OFF signal, i.e., is equal to "0" (low). Because of inverter 414, the AND gate 408 outputs in response a "1" or ON value, arbitrarily labeled "LDO disable" signal. The ON-OFF mode switch 418, in response to the LDO disable signal, closes. This places Vdd on the pass gate control line 180, switching the pass gate M9 OFF. Placing of Vdd on the pass gate control line 180, and switching OFF of the pass gate M9, can be alternatively referenced as an example of an "OFF override" of the pass gate control signal. Next, assume the system ON-OFF mode signal remains at "1" (in other words, the system ON-OFF mode ON signal is received) but the Bypass mode signal switches to the Bypass mode ON signal, the Bypass mode signal transitions to "1." Because of the inverter 414, the AND gate 408 output transitions to "0," which opens the ON-OFF mode switch 418. Concurrently (or after) the above-described opening of the ON-OFF mode switch 418, the Bypass mode ON signal, acting through control line 412, closes the bypass mode switch 416. The closing of the bypass mode switch 416 shorts the pass gate control line 180 to a reference (e.g., ground) power rail, such as Vss. Pass gate M9 is therefore switched ON hard, i.e., to a fully saturated state. The placing of Vss on the pass gate control line 180, and switching ON of the pass gate M9, can be alternatively referenced as an example of an "ON override" of the pass gate control signal.

Figure 5A:
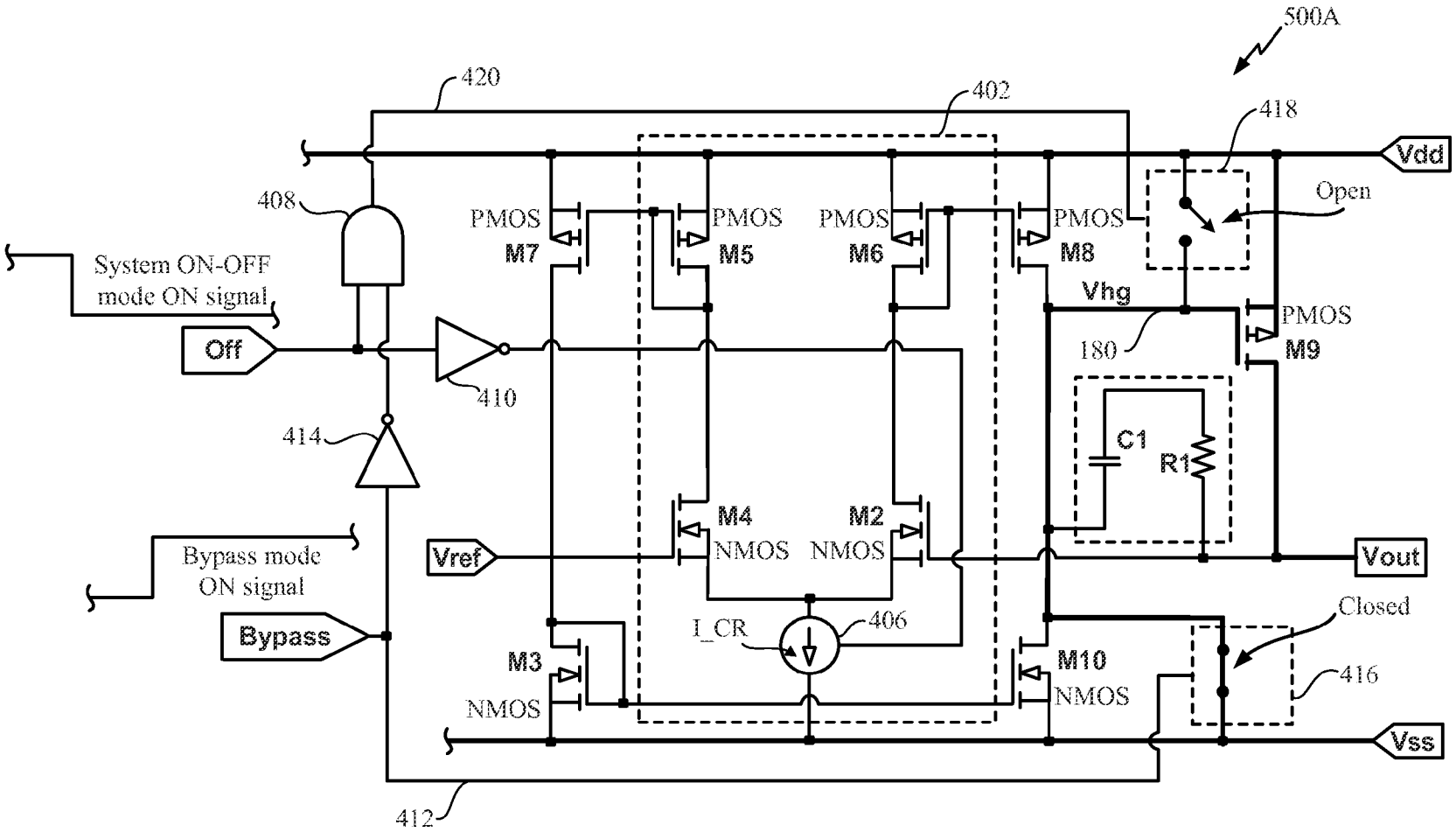
FIG. 5A shows the FIG. 4 bypass mode/ON-OFF mode LDO regulator in a bypass while powered up mode in accordance with one or more exemplary embodiments.

FIG. 5A shows the FIG. 4 bypass mode/ON-OFF mode LDO regulator 400 in state 500A, which results from receiving the Bypass mode ON signal, the Bypass mode signal being "1," concurrent with receiving the system ON-OFF mode ON signal, i.e., the system ON-OFF mode signal being "0." This may be termed, for example, a "bypass while powered up" mode. As shown, in this "bypass while powered up" mode, the AND gate 408 outputs a "0," which opens the ON-OFF mode switch 418. The inverter 410 outputs a "1," which causes the switchable tail current source 406 to source an operating biasing current I_CR. The Bypass mode signal being "1" (i.e., being the Bypass mode ON signal) closes the bypass mode switch 416, shorting the pass gate control line 180 to Vss, which switches or forces the pass gate M9 ON hard. In other words, concurrently receiving the ON-OFF mode ON signal and the Bypass mode ON signal provides an ON override of the pass gate control signal.

Figure 5B:
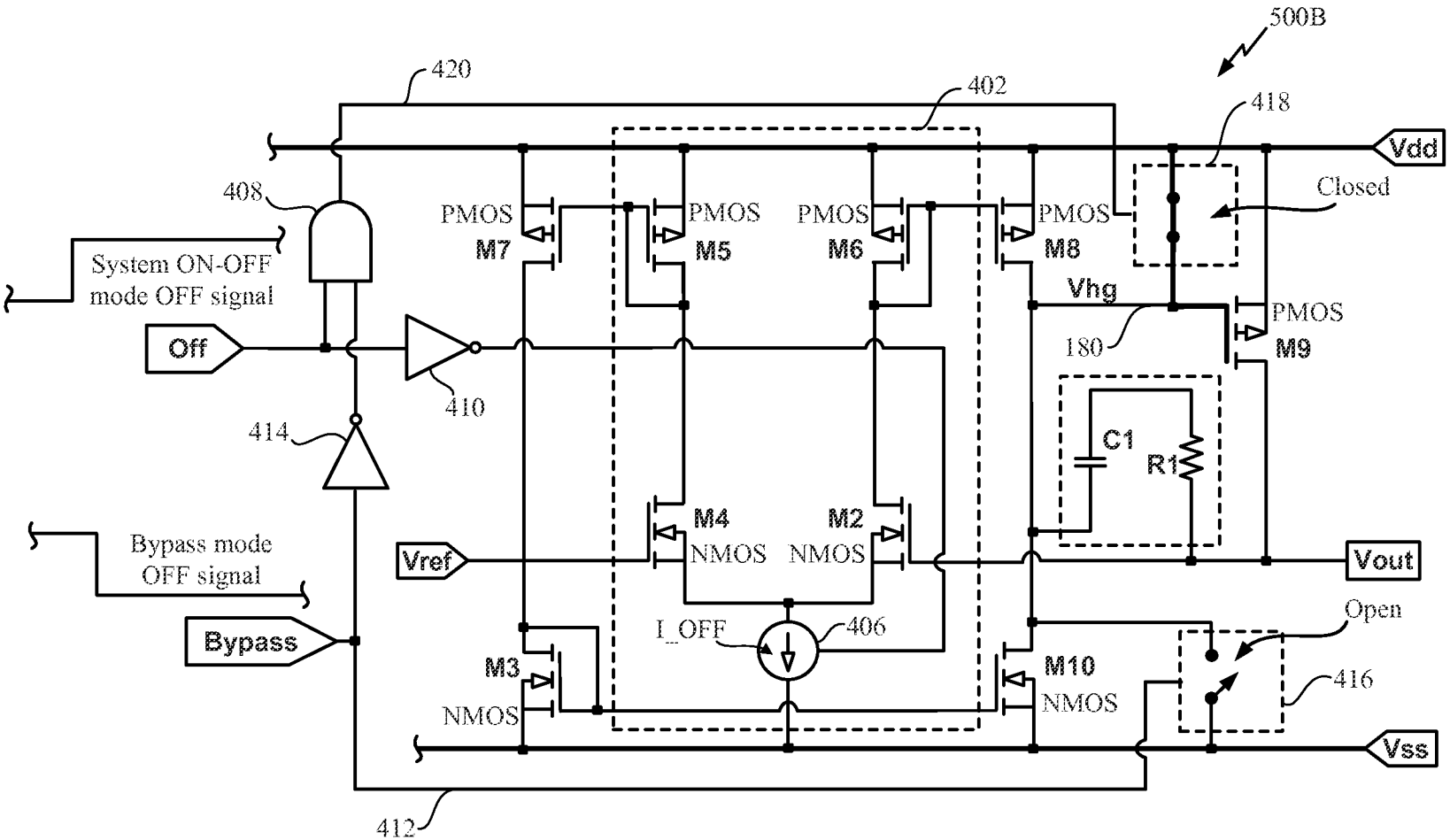
FIG. 5B shows the FIG. 4 bypass mode/ON-OFF mode LDO regulator in a bypass OFF while powered down mode in accordance with one or more exemplary embodiments.

FIG. 5B shows the FIG. 4 bypass mode/ON-OFF mode LDO regulator 400 in state 500B, which results from receiving the Bypass mode OFF signal (i.e., the Bypass mode signal being "0") concurrent with receiving the system ON-OFF mode OFF signal (i.e., the system ON-OFF mode signal being "1"). This may be termed, for example, a "bypass OFF while powered down" mode. As shown, because of the inverter 414, the AND gate 408 outputs a "I," which closes the ON-OFF mode switch 418. Concurrently, in a co-operative manner, the Bypass mode OFF signal (i.e., the Bypass mode OFF signal being "0") opens the bypass mode switch 416. As a result, the pass gate control line 180 is at Vdd, disabling the pass gate M9. In other words, concurrently receiving the ON-OFF mode OFF signal and the Bypass mode OFF signal provides an ON override of the pass gate control signal. In addition, the inverter 410 outputs a "0," which switches the switchable tail current source 406 OFF, or causes it to source a reduced power-down operating current I_OFF. The reduced power-down operating current may be alternatively referenced as an "off state biasing current."

Figure 5C:
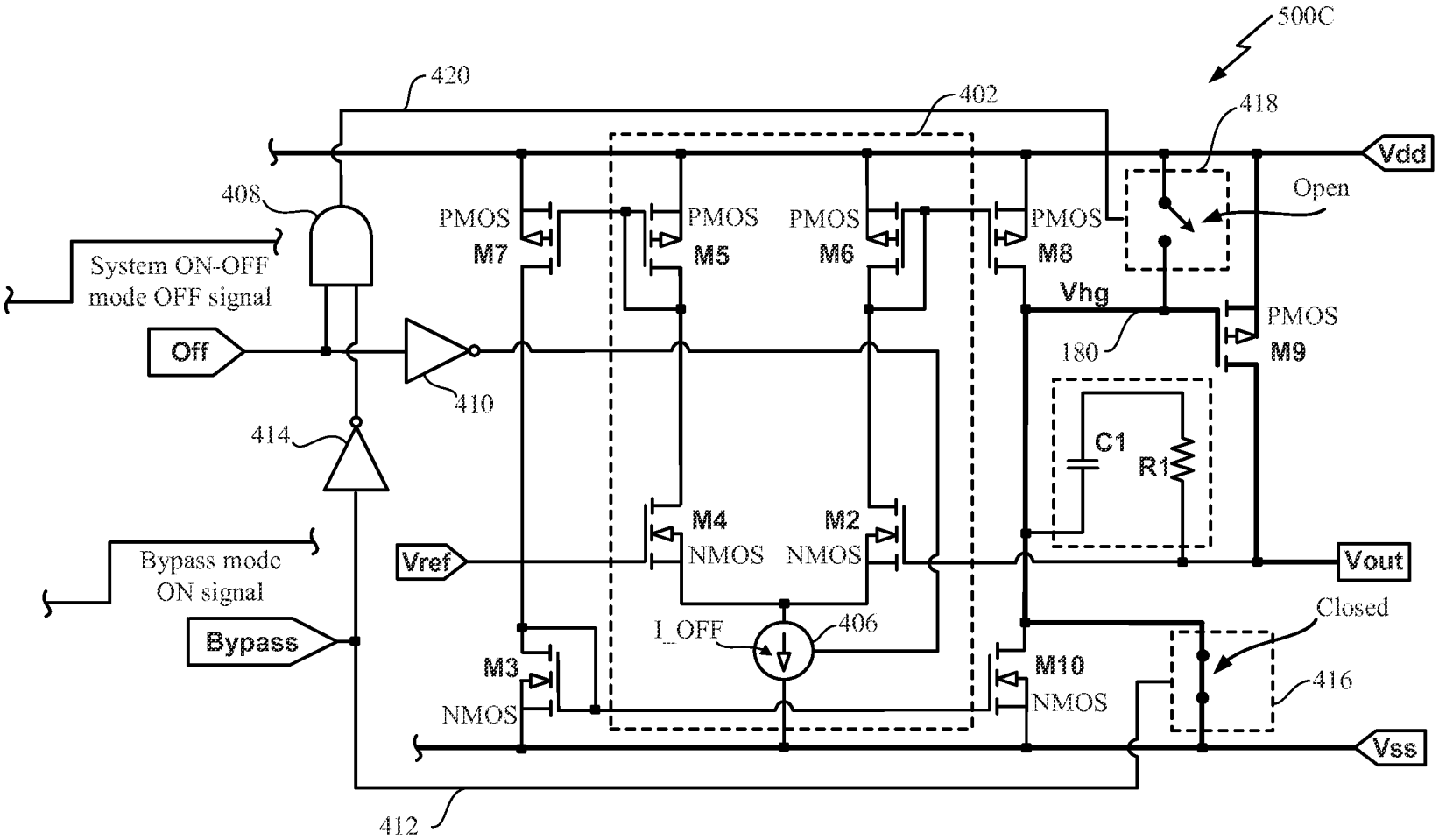
FIG. 5C shows the FIG. 4 bypass mode/ON-OFF mode LDO regulator in a bypass ON while powered down mode in accordance with one or more exemplary embodiments.

FIG. 5C shows the FIG. 4 bypass mode/ON-OFF mode LDO regulator 400 in state 500C, which results from receiving the Bypass mode ON signal (i.e., the Bypass mode signal being "1") concurrent with the system ON-OFF mode OFF signal (i.e., the system ON-OFF mode signal being "1"). This may be termed, for example, a "bypass ON while powered down" mode. Because of the inverter 414, the AND gate 408 outputs a "0," which opens the ON-OFF mode switch 418. Stated differently, with respect to the ON-OFF mode switch 418, the Bypass mode signal being at "1" causes it to override action by the system ON-OFF mode signal. Concurrently, in a co-operative manner, the Bypass mode signal state of "1" closes the bypass mode switch 416. As a result, the pass gate control line 180 is at Vss, switching or forcing the pass gate M9 ON hard, i.e., to a fully saturated state. In other words, concurrently receiving the ON-OFF mode OFF signal and the Bypass mode ON signal provides an ON override of the pass gate control signal. The power down operation of the ON-OFF mode on the switchable tail current source 406, however, is not affected. More specifically, the inverter 410 outputs a "0," which switches the switchable tail current source 406 OFF, or causes it to source the reduced power-down operating current I_OFF.

It will be appreciated by persons of ordinary skill in the art, from reading this disclosure, that various exemplary embodiments provide, among other features and benefits, efficient use of silicon area by using the output device of the LDO (e.g., the pass gate M9) as part of the headswitch PMOS when the LDO is not being used for voltage regulation.

Figure 6:
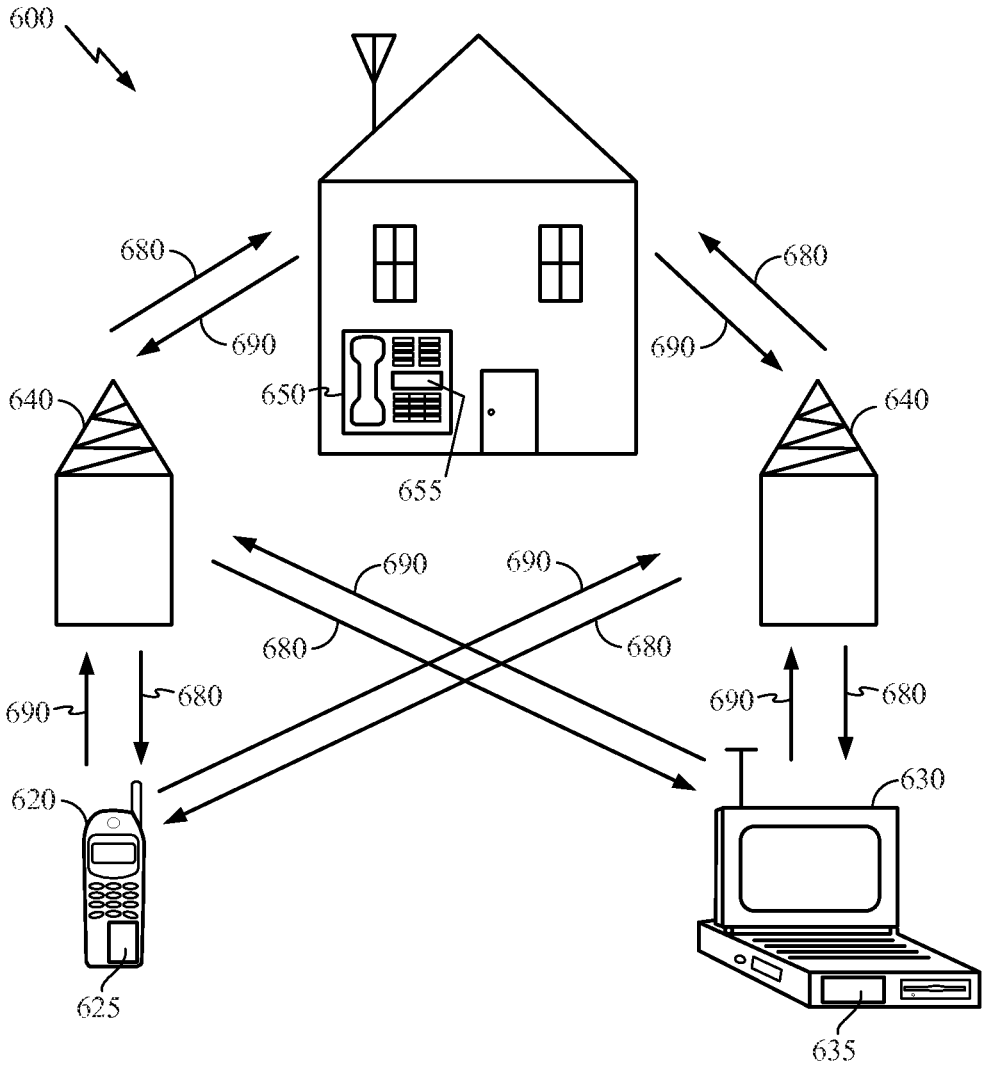
FIG. 6 shows one system diagram of one wireless communication system having, supporting, integrating and/or employing bypass mode, or bypass mode/ON-OFF mode LDO units in accordance with one or more exemplary embodiments.

FIG. 6 illustrates an exemplary wireless communication system 600 in which one or more embodiments of the disclosure may be advantageously employed. For purposes of illustration, FIG. 6 shows three remote units 620, 630, and 650 and two base stations 640. It will be recognized that conventional wireless communication systems may have many more remote units and base stations. The remote units 620, 630, and 650 include integrated circuit or other semiconductor devices 625, 635 and 655 (including on-chip voltage regulators, as disclosed herein), which are among embodiments of the disclosure as discussed further below. FIG. 6 shows forward link signals 680 from the base stations 640 and the remote units 620, 630, and 650 and reverse link signals 690 from the remote units 620, 630, and 650 to the base stations 640.

in FIG. 6, the remote unit 620 is shown as a mobile telephone, the remote unit 630 is shown as a portable computer, and the remote unit 650 is shown as a fixed location remote unit in a wireless local loop system. For example, the remote units may be any one or combination of a mobile phone, hand-held personal communication system (PCS) unit, portable data unit such as a personal data assistant (PDA), navigation device (such as GPS enabled devices), set top box, music player, video player, entertainment unit, fixed location data unit such as meter reading equipment, or any other device that stores or retrieves data or computer instructions, or any combination thereof. Although FIG. 6 illustrates remote units according to the teachings of the disclosure, the disclosure is not limited to these exemplary illustrated units. Embodiments of the disclosure may be suitably employed in any device having active integrated circuitry including memory and on-chip circuitry for test and characterization.

The foregoing disclosed devices and functionalities (such as the devices of FIG. 2, 3 or 4 or any combination thereof) may be designed and configured into computer files (e.g., RTL, GDSII, GERBER, etc.) stored on computer readable media, for example a computer readable tangible medium. Some or all such files may be provided to fabrication handlers who fabricate devices based on such files. Resulting products include semiconductor wafers that are then cut into semiconductor die and packaged into a semiconductor chip. The semiconductor chips can be employed in electronic devices, such as described hereinabove.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor.

Accordingly, an embodiment of the invention can include a computer readable media embodying a method for implementation. Accordingly, the invention is not limited to illustrated examples and any means for performing the functionality described herein are included in embodiments of the invention.

The foregoing disclosed devices and functionalities may be designed and configured into computer files (e.g. RTL, GDSII, GERBER, etc.) stored on computer readable media. Some or all such files may be provided to fabrication handlers who fabricate devices based on such files. Resulting products include semiconductor wafers that are then cut into semiconductor die and packaged into a semiconductor chip. The chips are then employed in devices described above.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A bypass low dropout regulator comprising:

a pass gate coupled to a supply rail and having a regulator output and a control terminal, configured to controllably couple, in response to receiving a pass gate control signal on the control terminal, the supply rail to the regulator output;

a differential amplifier, configured to generate the pass gate control signal, based on a reference voltage and a feedback of the regulator output;

a pass gate control line, coupling an output of the differential amplifier to the control terminal, for carrying the pass gate control signal; and a bypass mode circuit configured to selectively ON override the pass gate control signal in response to a bypass mode signal, wherein the ON override places a pass gate ON hard voltage on the control terminal, wherein the bypass mode circuit is configured to receive the bypass mode signal at a value switchable between a bypass mode ON signal and a bypass mode OFF signal, and is configured to ON override the pass gate control signal in response to receiving the bypass mode ON signal, and wherein the bypass mode circuit is configured to perform the ON override by shorting the pass gate control line, in response to receiving the bypass mode ON signal, to a power rail having the pass gate ON hard voltage.

2. The bypass low dropout regulator of claim 1, wherein the bypass mode circuit comprises a bypass mode switch configured to receive the bypass mode signal and, in response to the bypass mode ON signal, to perform the shorting and, in response to the bypass mode OFF signal, to not perform the shorting.

3. A bypass low dropout regulator comprising:

a pass gate coupled to a supply rail and having a regulator output and a control terminal, configured to controllably couple, in response to receiving a pass gate control signal on the control terminal, the supply rail to the regulator output;

a differential amplifier, configured to generate the pass gate control signal, based on a reference voltage and a feedback of the regulator output;

a bypass mode circuit configured to selectively ON override the pass gate control signal in response to a bypass mode signal, wherein the bypass mode circuit is configured to receive the bypass mode signal at a value switchable between a bypass mode ON signal and a bypass mode OFF signal, and is configured to ON override the pass gate control signal in response to receiving the bypass mode ON signal, wherein the ON override places a pass gate ON hard voltage on the control terminal;

an ON-OFF mode switch configured to OFF override the pass gate control signal in response to receiving an LDO disable signal, wherein the OFF override places a pass gate OFF voltage on the control terminal; and an ON-OFF/bypass resolution logic, wherein the ON-OFF/bypass resolution logic is configured to receive the bypass mode signal and a system ON-OFF mode signal and, in response, to select in accordance with a given priority between generating the LDO disable signal and not generating the LDO disable signal.

4. The bypass low dropout regulator of claim 3, wherein the ON-OFF/ bypass resolution logic is further configured to generate the LDO disable signal in response to a concurrence of receiving the bypass mode OFF signal and the system ON-OFF mode OFF signal.

5. The bypass low dropout regulator of claim 3, wherein the differential amplifier comprises:

a first branch having a first transistor;

a second branch having a second transistor, wherein the first branch and the second branch are coupled at a common node; and a switchable tail current source coupled to the common node and controlled by the system ON-OFF mode signal, configured to switch to an ON state and source an operating biasing current in response to the system ON-OFF mode ON signal, and to switch to an OFF state and source an OFF state biasing current, less than the operating biasing current, in response to the system ON-OFF mode OFF signal.

6. A bypass low dropout regulator, comprising:

a pass gate coupled to a supply rail and having a regulator output and a control terminal, configured to controllably couple, in response to receiving a pass gate control signal on the control terminal, the supply rail to the regulator output;

a differential amplifier, configured to generate the pass gate control signal, based on a reference voltage and a feedback of the regulator output;

a bypass mode circuit configured to selectively ON override the pass gate control signal in response to a bypass mode signal, wherein the ON override places a pass gate ON hard voltage on the control terminal;

an ON/OFF bypass resolution logic configured to receive the bypass mode signal and a system ON-OFF mode signal and, in response to a concurrence of receiving the bypass mode OFF signal and the system ON-OFF mode OFF signal, to generate an LDO disable signal; and an ON-OFF mode switch configured to receive the LDO disable signal and, in response, perform an OFF override of the pass gate control signal, wherein the OFF override places a pass gate OFF voltage on the control terminal.

7. The bypass low dropout regulator of claim 6, wherein the differential amplifier comprises:

a first branch having a first transistor;

a second branch having a second transistor, wherein the first branch and the second branch are coupled at a common node; and a switchable tail current source coupled to the common node and controlled by the system ON-OFF mode signal.

8. The bypass low dropout regulator of claim 6, wherein the a switchable tail current source is configured to switch to an ON state and source an operating biasing current in response to the system ON-OFF mode ON signal, and to switch to an OFF state and source an OFF state biasing current, less than the operating biasing current, in response to the system ON-OFF mode OFF signal.

9. A method for bypassing a low dropout regulator comprising:

generating a pass gate control signal based on a difference between a regulated output voltage of a pass gate and a reference voltage;

receiving a bypass mode signal that is switchable between a bypass mode ON signal and a bypass mode OFF signal;

receiving a system ON-OFF mode signal that is switchable between a system ON-OFF mode ON signal and a system ON-OFF mode OFF signal; and conditionally controlling a conductance of the pass gate based at least on the pass gate control signal, receiving the system ON-OFF mode signal, and receiving the bypass mode signal, wherein the conductance of the pass gate is based, at least in part, on the pass gate control signal when receiving the bypass mode OFF signal, wherein, when receiving the bypass mode ON signal, the conductance of the pass gate is based, at least in part, on the bypass mode ON signal, and wherein conditionally controlling the conductance includes, in response to a concurrence of receiving the bypass mode OFF signal and the system ON-OFF mode OFF signal, disabling the pass gate.

10. The method of claim 9, wherein controlling the conductance of the pass gate when receiving the bypass mode ON signal comprises placing a pass gate ON voltage on a control terminal of the pass gate.

11. The method of claim 9, wherein controlling the conductance of the pass gate when receiving the bypass mode ON signal comprises shorting a control terminal of the pass gate to a power rail having a pass gate ON voltage.

12. The method of claim 9, wherein controlling the conductance of the pass gate when receiving the bypass mode ON signal comprises overriding the pass gate control signal.

13. The method of claim 9, wherein conditionally controlling the conductance of the pass gate further includes, in response to a concurrence of receiving the bypass mode ON signal and the system ON-OFF mode ON signal, switching the pass gate ON hard.

14. The method of claim 9, wherein disabling the pass gate comprises placing a pass gate OFF voltage on a control terminal of the pass gate.

15. An apparatus for bypassing a low dropout regulator comprising:

means for generating a pass gate control signal based on a difference between a regulated output voltage of a pass gate and a reference voltage; and means for conditionally controlling a conductance of the pass gate based at least on the pass gate control signal and receiving a bypass mode signal that is switchable between a bypass mode ON signal and a bypass mode OFF signal, wherein the means for conditionally controlling is configured to control the conductance of the pass gate based, at least in part, on the pass gate control signal when receiving the bypass mode OFF signal and, when receiving the bypass mode ON signal, to control the conductance of the pass gate based, at least in part, on the bypass mode ON signal, and wherein the means for conditionally controlling the conductance of the pass gate is further configured to control the conductance of the pass gate further based on receiving a system ON-OFF mode signal that is switchable between a system ON-OFF mode ON signal and a system ON-OFF mode OFF signal, and to include in the controlling, in response to a concurrence of receiving the bypass mode OFF signal and the system ON-OFF mode OFF signal, disabling the pass gate.

16. The apparatus of claim 15, wherein the means for conditionally controlling the conductance of the pass gate is further configured to control the conductance of the pass gate, in response to a concurrence of receiving the bypass mode ON signal and the system ON-OFF mode OFF signal, switching the pass gate ON hard.

* * * * *